US012599206B2

(12) United States Patent
Balderas

(10) Patent No.: US 12,599,206 B2
(45) Date of Patent: Apr. 14, 2026

(54) UMBRELLA POLE BRACE ASSEMBLY

(71) Applicant: Carlos Balderas, Haslet, TX (US)

(72) Inventor: Carlos Balderas, Haslet, TX (US)

( * ) Notice: Subject to any disclaimer, the term of this patent is extended or adjusted under 35 U.S.C. 154(b) by 283 days.

(21) Appl. No.: 18/222,144

(22) Filed: Jul. 14, 2023

(65) Prior Publication Data

US 2025/0017336 A1 Jan. 16, 2025

(51) Int. Cl.
*A45B 9/00* (2006.01)
*A45B 17/00* (2006.01)
*A45B 23/00* (2006.01)

(52) U.S. Cl.
CPC ..... *A45B 9/00* (2013.01); *A45B 17/00* (2013.01); *A45B 23/00* (2013.01); *A45B 2023/0012* (2013.01)

(58) Field of Classification Search
CPC ..... A45B 9/00
See application file for complete search history.

(56) References Cited

U.S. PATENT DOCUMENTS

| | | | | |
|---|---|---|---|---|
| 4,520,590 | A | 6/1985 | Schuh | |
| 4,949,525 | A | 8/1990 | Weaver | |
| 5,020,764 | A * | 6/1991 | Yamamoto | E04H 12/2246 248/910 |
| 5,207,255 | A | 5/1993 | Shannon | |
| 5,738,129 | A | 4/1998 | Vogt | |
| 6,715,504 | B2 | 4/2004 | Chen | |
| D496,000 | S | 9/2004 | Cornell | |
| 8,500,609 | B1 * | 8/2013 | Williams | A63B 21/0726 135/65 |
| 8,714,174 | B1 * | 5/2014 | DeSousa | E04H 15/58 135/117 |
| 9,125,467 | B2 * | 9/2015 | Randel | E04H 15/32 |
| 11,814,859 | B2 * | 11/2023 | Razzano | E04H 15/58 |
| 2016/0024813 | A1 * | 1/2016 | Koyl | E04H 12/2269 135/120.1 |
| 2021/0112932 | A1 * | 4/2021 | Ma | A45B 17/00 |

FOREIGN PATENT DOCUMENTS

| | | |
|---|---|---|
| CA | 2060968 | 2/1992 |

* cited by examiner

*Primary Examiner* — Noah Chandler Hawk

(57) ABSTRACT

An umbrella pole brace assembly includes an umbrella that has a pole and a pivoting mechanism for facilitating a top portion of the pole to be oriented at an angle with a bottom portion of the pole thereby facilitating the umbrella to be retained in a tilted orientation. A pair of half pipes is hingedly coupled together such that the pair of half pipes forms a sleeve which is positionable around the pole of the umbrella for covering the pivoting mechanism. Each of the pair of half pipes includes a rigid material facilitating the sleeve formed by the pair of half pipes to inhibit the pivoting mechanism from pivoting for retaining the umbrella in a horizontal orientation.

6 Claims, 6 Drawing Sheets

UMBRELLA POLE BRACE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pole brace devices and more particularly pertains to a new pole brace device for retaining an umbrella in a horizontal orientation when a pivoting mechanism in a pole of the umbrella has failed. The device includes a pair of half pipes that are hingedly coupled together such that the pair of half pipes forms a sleeve when the pair of half pipes are in a closed position. Additionally, the device includes a pair of latches for retaining the pair of half pipes in the closed position around the pivoting mechanism of the pole to inhibit the pivoting mechanism from pivoting.

(2) Description of Related Art Including Information Disclosed Under 37 CFR 1.97 and 1.98

The prior art relates to pole brace devices including various pivoting locks for umbrella frames and a sleeve, formed by a pair of half pipes pivotally attached together, that are positionable around a hose to stopping a leak in the hose. In no instance does the prior art disclose a pair of half pipes hingedly coupled together which forms a sleeve which is positionable around a pole of an umbrella to support a failed pivoting mechanism in the pole.

BRIEF SUMMARY OF THE INVENTION

An embodiment of the disclosure meets the needs presented above by generally comprising an umbrella that has a pole and a pivoting mechanism for facilitating a top portion of the pole to be oriented at an angle with a bottom portion of the pole thereby facilitating the umbrella to be retained in a tilted orientation. A pair of half pipes is hingedly coupled together such that the pair of half pipes forms a sleeve which is positionable around the pole of the umbrella for covering the pivoting mechanism. Each of the pair of half pipes is comprised of a rigid material thereby facilitating the sleeve formed by the pair of half pipes to inhibit the pivoting mechanism from pivoting for retaining the umbrella in a horizontal orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
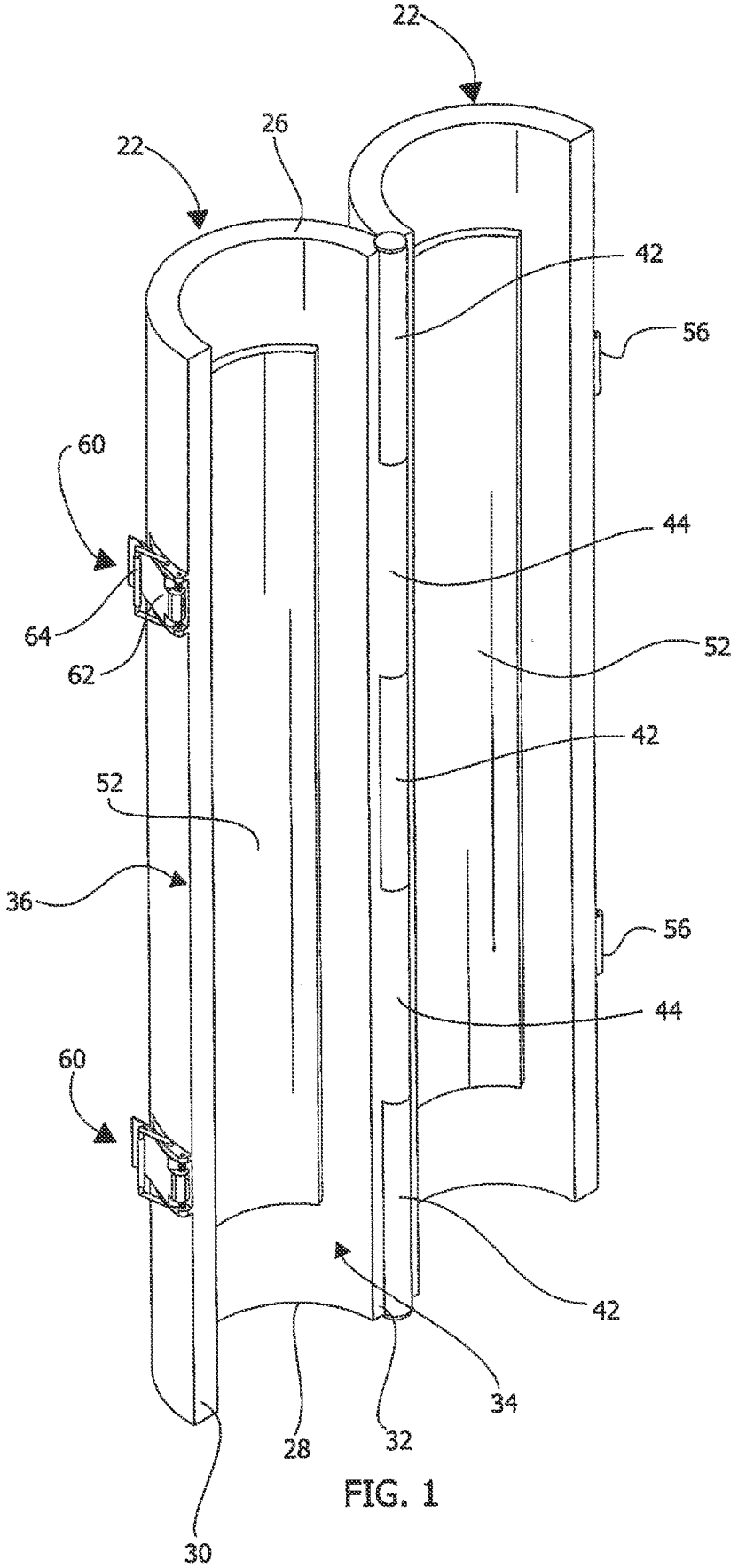
FIG. 1 is a perspective view of an umbrella pole brace assembly according to an embodiment of the disclosure showing a pair of half pipes in an open position.
Figure 2:
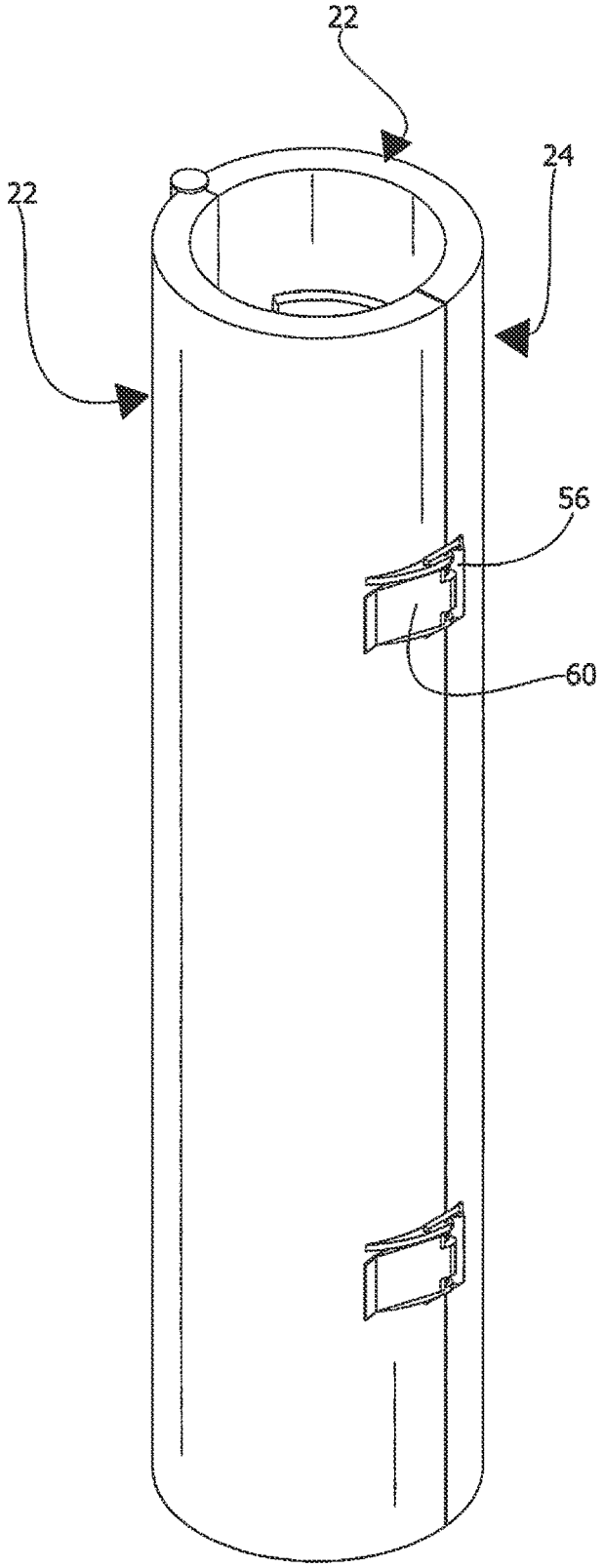
FIG. 2 is a perspective view of an embodiment of the disclosure showing a pair of half pipes in a closed position.
Figure 3:
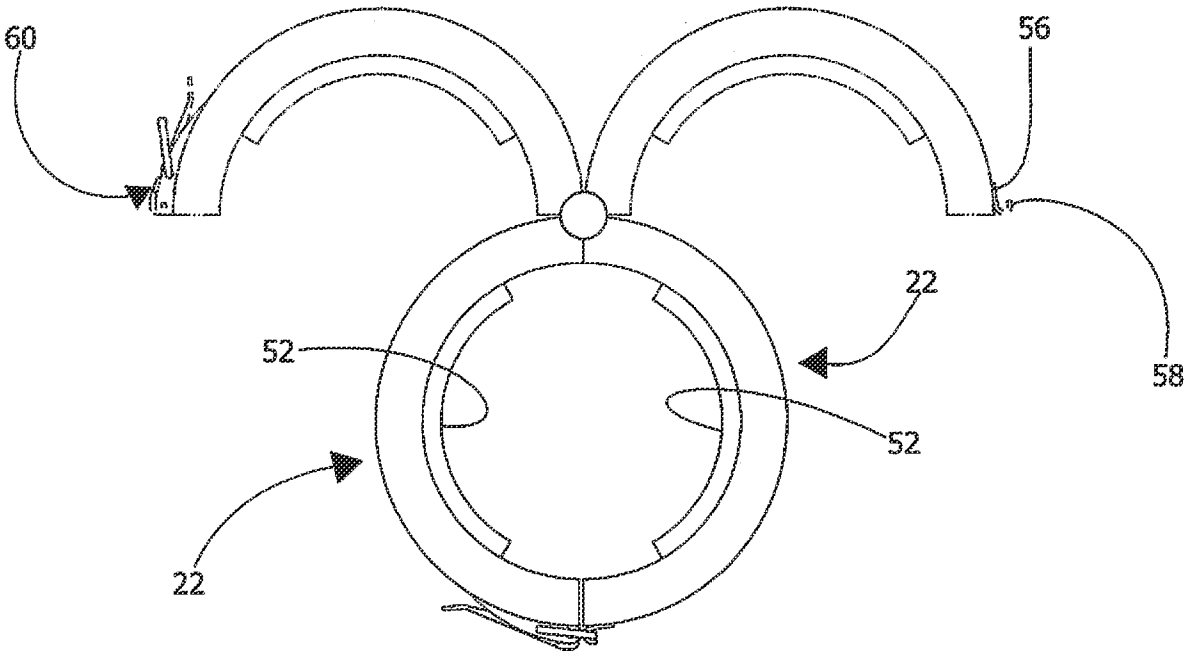
FIG. 3 is a top view of an embodiment of the disclosure.
Figure 4:
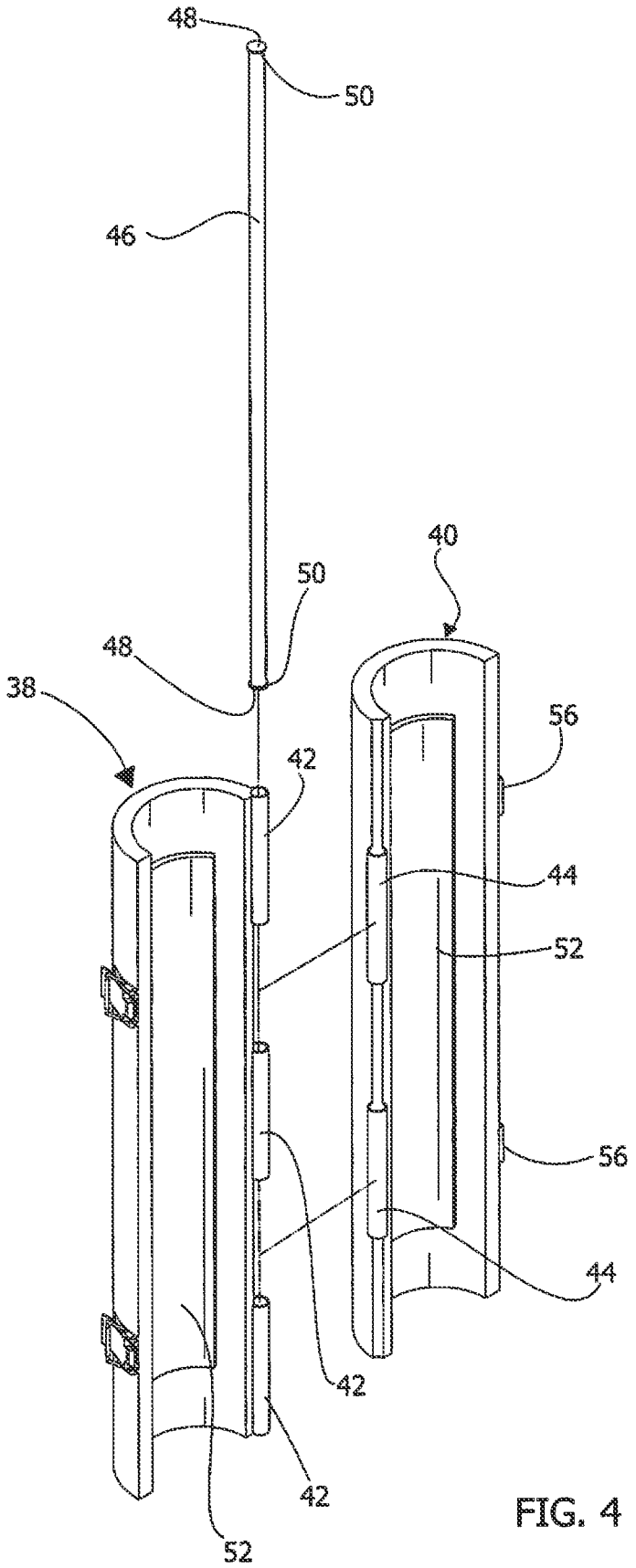
FIG. 4 is an exploded perspective view of an embodiment of the disclosure.
Figure 5:
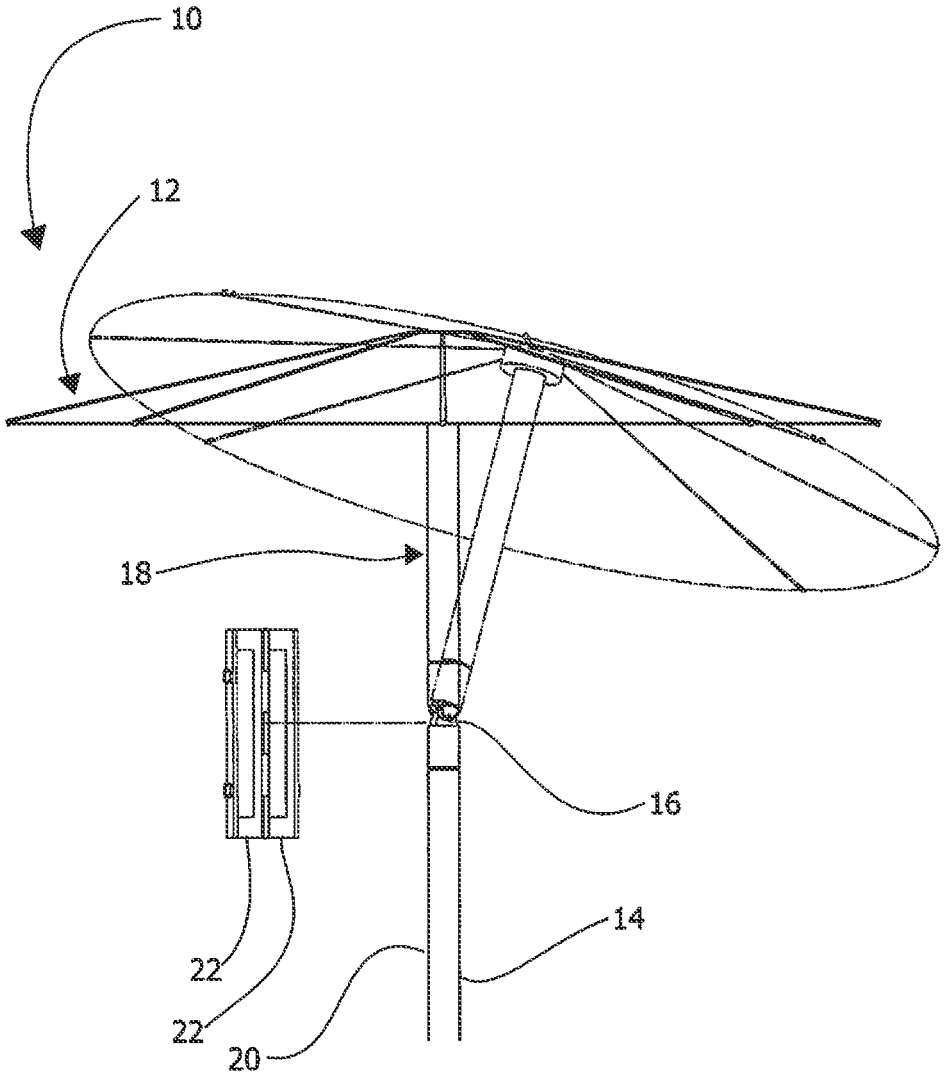
FIG. 5 is an exploded in-use view of an embodiment of the disclosure.
Figure 6:
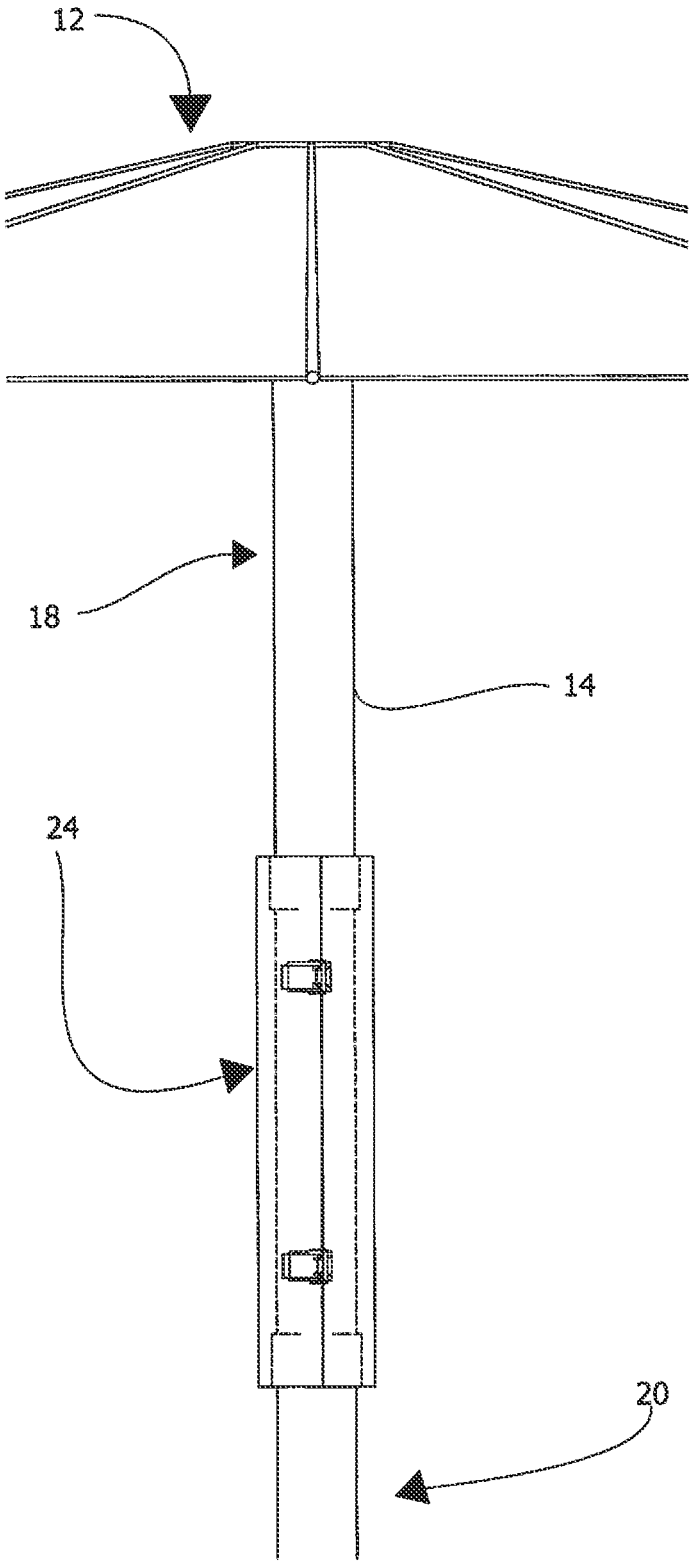
FIG. 6 is a perspective in-use view of an embodiment of the disclosure.

With reference now to the drawings, and in particular to FIGS. 1 through 6 thereof, a new pole brace device embodying the principles and concepts of an embodiment of the disclosure and generally designated by the reference numeral 10 will be described.

As best illustrated in FIGS. 1 through 6, the umbrella pole brace assembly 10 generally comprises an umbrella 12 that has a pole 14. The pole 14 has a pivoting mechanism 16 for facilitating a top portion 18 of the pole 14 to be oriented at an angle with a bottom portion 20 of the pole 14 thereby facilitating the umbrella 12 to be retained in a tilted orientation. The umbrella 12 may be a patio umbrella that is commonly employed for shade in an outdoor setting. Furthermore, the pivoting mechanism 16 in umbrella poles are known to be prone to failure such that the pivoting mechanism 16 is no longer capable of retaining the top portion 18 in an upright orientation.

A pair of half pipes 22 is provided and each of the pair of half pipes 22 is hingedly coupled together. The pair of half pipes 22 is positionable in a closed position such that the pair of half pipes 22 forms a sleeve 24 which is positionable around the pole 14 of the umbrella 12 having the sleeve 24 covering the pivoting mechanism 16. Furthermore, each of the pair of half pipes 22 is comprised of a rigid material thereby facilitating the sleeve 24 formed by the pair of half pipes 22 to inhibit the pivoting mechanism 16 from pivoting. In this way the umbrella 12 is retained in a horizontal orientation when the pivoting mechanism 16 has failed and is no longer capable of retaining the umbrella 12 in the horizontal orientation.

Each of the pair of half pipes 22 has a first end 26 and a second end 28 and each of the pair of half pipes 22 has a first lateral edge 30 and a second lateral edge 32 each extending between the first end 26 and the second end 28. Each of the pair of half pipes 22 has an inwardly facing surface 34 and an outwardly facing surface 36 and the inwardly facing surface 34 of each of the half pipes 22 is concavely arcuate between the first lateral edge 30 and the second lateral edge 32. The pair of half pipes 22 includes a first half pipe 38 and a second half pipe 40 and the first half pipe 38 has a plurality of first tubes 42 each disposed on the second lateral edge 32 of the first half pipe 38. The plurality of first tubes 42 is evenly spaced apart from each other and each of the plurality of first tubes 42 is spaced from a respective one of the first end 26 and the second end 28 of the first half pipe 38. Additionally, each of the plurality of first tubes 42 is oriented to extend longitudinally along the second lateral edge 32 of the first half pipe 38.

The second half pipe 40 has a plurality of second tubes 44 that is each disposed on the first lateral edge 30 of the second half pipe 40. The second tubes 44 are evenly spaced apart from each other and each of the second tubes 44 is spaced from a respective one of the first end 26 and the second end 28 of the second half pipe 40. Additionally, each of the plurality of second tubes 44 is oriented to extend longitudinally along the first lateral edge 30 of the second half pipe 40 and the plurality of first tubes 42 is interlaced with the plurality of second tubes 44. A pin 46 extends through each of the plurality of first tubes 42 and each of the plurality of second tubes 44 for hingedly retaining the first half pipe 38 on the second half pipe 40. Furthermore, the pin 46 has a pair of heads 48 each disposed on opposing ends 50 of the pin 46 to inhibit the pin 46 from being removed from the plurality of first tubes 42 and the plurality of second tubes 44.

A pair of pads 52 is provided and each of the pads 52 is bonded to a respective one of the pair of half pipes 22. Each of the pads 52 is comprised of a resiliently compressible material thereby facilitating each of pair of pads 52 to compressed against the pole 14 when the pair pads 52 is positioned in the closed position around the pole 14. In this way the pair of pads 52 is inhibited from sliding on the pole 14. Each of the pads 52 has a bonded surface 54 which is bonded to the inwardly facing surface 34 of the respective half pipe 22 and each of the pair of pads 52 extends a substantial distance between the first end 26 and the second end 28 of the respective half pipe 22. Each of the pair of pads 52 extends a substantial distance between the first lateral edge 30 and the second lateral edge 32 of the respective half pipe 22 and each of the pair of pads 52 is centrally located on the inwardly facing surface 34 of the respective half pipe 22.

A pair of engagements 56 is provided and each of the pair of engagements 56 is coupled to a respective one of the pair of half pipes 22. Each of the pair of engagements 56 is positioned on the outwardly facing surface 36 of the second half pipe 40 and each of the pair of engagements 56 is aligned with the second lateral edge 32 of the second half pipe 40. Additionally, each of the engagements 56 has a finger 58 which curls away from the second lateral edge 32 of the second half pipe 40. A pair of latches 60 is included and each of the latches 60 is movably attached to a respective one of the pair of half pipes 22. Each of the latches 60 is urgeable into a locking condition having each of the latches 60 engaging a respective one of the pair of engagements 56 for retaining the pair of half pipes 22 in the closed position. Conversely, each of the latches 60 is urgeable into an unlocking condition having each of the latches 60 being disengaged from the respective engagement 56 for facilitating the pair of half pipes 22 to be positioned in an open position.

Each of the latches 60 is positioned on the outwardly facing surface 36 of the first half pipe 38 and each of the latches 60 is aligned with the first lateral edge 30 of the first half pipe 38. Each of the pair of latches 60 is aligned with a respective one of the pair of engagements 56. Additionally, each of the latches 60 includes a lever 62 pivotally attached to the outwardly facing surface 36 of the first half pipe 38 and a loop 64 movably attached to the lever 62. The loop 64 extends around the finger 58 associated with the respective engagement 56 and urges the second lateral edge 32 of the second half pipe 40 to compress against the second lateral edge 32 of the first half pipe 38 when the lever 62 is pivoted into a closing position. The loop 64 is displaced from the finger 58 associated with the respective engagement 56 to facilitate the second lateral edge 32 of the second half pipe 40 to be spaced from the first lateral edge 30 of the first half pipe 38.

In use, the pair of half pipes 22 is positioned in the closed position around the pole 14 of the umbrella 12 such that the sleeve 24 formed by the pair of half pipes 22 encloses the pivoting mechanism 16. Additionally, each of the latches 60 is urged into the locking condition for retaining the sleeve 24 around the pole 14. In this way the umbrella 12 can be retained in a horizontal orientation when the pivoting mechanism 16 in the pole 14 is no longer capable of retaining the umbrella 12 in the horizontal orientation. Thus, the umbrella 12 can continue to be utilized without the need to purchase a new umbrella when the pivoting mechanism 16 has failed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An umbrella pole brace assembly for retaining an umbrella pole in an upright position which a pivoting mechanism in the umbrella pole is broken, said assembly comprising:

an umbrella having a pole, said pole having a pivoting mechanism for facilitating a top portion of said pole to be oriented at an angle with a bottom portion of said pole thereby facilitating said umbrella to be retained in a tilted orientation;

a pair of half pipes, each of said pair of half pipes being hingedly coupled together, said pair of half pipes being positionable in a closed position such that said pair of half pipes forms a sleeve which is positionable around said pole of said umbrella having said sleeve covering said pivoting mechanism, each of said pair of half pipes being comprised of a rigid material thereby facilitating said sleeve formed by said pair of half pipes to inhibit said pivoting mechanism from pivoting for retaining said umbrella in a horizontal orientation;

a pair of pads, each of said pads being bonded to a respective one of said pair of half pipes, each of said pads being comprised of a resiliently compressible material thereby facilitating each of pair of pads to compressed against said pole when said pair pads is positioned in said closed position around said pole thereby inhibiting said pair of pads from sliding on said pole;

a pair of engagements, each of said pair of engagements being coupled to a respective one of said pair of half pipes;

a pair of latches, each of said latches being movably attached to a respective one of said pair of half pipes, each of said latches being urgeable into a locking condition having each of said latches engaging a respective one of said pair of engagements for retaining said pair of half pipes in said closed position, each of said latches being urgeable into an unlocking condition having each of said latches being disengaged from said respective engagement for facilitating said pair of half pipes to be positioned in an open position;

wherein each of said pair of half pipes has a first end and a second end;

wherein each of said pair of half pipes has a first lateral edge and a second lateral edge each extending between said first end and said second end;

wherein each of said pair of half pipes has an inwardly facing surface and an outwardly facing surface;

wherein said inwardly facing surface of each of said half pipes is concavely arcuate between said first lateral edge and said second lateral edge;

wherein said pair of half pipes includes a first half pipe and a second half pipe;

wherein said first half pipe has a plurality of first tubes each being disposed on said second lateral edge of said first half pipe, said plurality of first tubes being evenly spaced apart from each other, each of said plurality of first tubes being spaced from a respective one of said first end and said second end of said first half pipe, each of said plurality of first tubes being oriented to extend longitudinally along said second lateral edge of said first half pipe; and wherein said second half pipe has a plurality of second tubes each being disposed on said first lateral edge of said second half pipe, said plurality of second tubes being evenly spaced apart from each other, each of said plurality of second tubes being spaced from a respective one of said first end and said second end of said second half pipe, each of said plurality of second tubes being oriented to extend longitudinally along said first lateral edge of said second half pipe, said plurality of first tubes being interlaced with said plurality of second tubes.

2. The assembly according to claim 1, further comprising a pin extending through each of said plurality of first tubes and each of said plurality of second tubes for hingedly retaining said first half pipe on said second half pipe, said pin having a pair of heads each being disposed on opposing ends of said pin to inhibit said pin from being removed from said plurality of first tubes and said plurality of second tubes.

3. The assembly according to claim 1, wherein each of said pads has a bonded surface being bonded to said inwardly facing surface of said respective half pipe, each of said pair of pads extending a substantial distance between said first end and said second end of said respective half pipe, each of said pair of pads extending a substantial distance between said first lateral edge and said second lateral edge of said respective half pipe, each of said pair of pads being centrally located on said inwardly facing surface of said respective half pipe.

4. The assembly according to claim 1, wherein each of said pair of engagements is positioned on said outwardly facing surface of said second half pipe, each of said pair of engagements being aligned with said second lateral edge of said second half pipe, each of said engagements having a finger which curls away from said second lateral edge of said second half pipe.

5. The assembly according to claim 4, wherein;

each of said latches is positioned on said outwardly facing surface of said first half pipe, each of said latches being aligned with said first lateral edge of said first half pipe, each of said pair of latches being aligned with a respective one of said pair of engagements; and each of said latches includes a lever pivotally attached to said outwardly facing surface of said first half pipe and a loop movably attached to said lever, said loop extending around said finger associated with said respective engagement and urging said second lateral edge of said second half pipe to compress against said second lateral edge of said first half pipe when said lever is pivoted into a closing position, said loop being displaced from said finger associated with said respective engagement to facilitate said second lateral edge of said second half pipe to be spaced from said first lateral edge of said first half pipe.

6. An umbrella pole brace assembly for retaining an umbrella pole in an upright position which a pivoting mechanism in the umbrella pole is broken, said assembly comprising:

an umbrella having a pole, said pole having a pivoting mechanism for facilitating a top portion of said pole to be oriented at an angle with a bottom portion of said pole thereby facilitating said umbrella to be retained in a tilted orientation;

a pair of half pipes, each of said pair of half pipes being hingedly coupled together, said pair of half pipes being positionable in a closed position such that said pair of half pipes forms a sleeve which is positionable around said pole of said umbrella having said sleeve covering said pivoting mechanism, each of said pair of half pipes being comprised of a rigid material thereby facilitating said sleeve formed by said pair of half pipes to inhibit said pivoting mechanism from pivoting for retaining said umbrella in a horizontal orientation, each of said pair of half pipes having a first end and a second end, each of said pair of half pipes having a first lateral edge and a second lateral edge each extending between said first end and said second end, each of said pair of half pipes having an inwardly facing surface and an outwardly facing surface, said inwardly facing surface of each of said half pipes being concavely arcuate between said first lateral edge and said second lateral edge, said pair of half pipes including a first half pipe and a second half pipe, said first half pipe having a plurality of first tubes each being disposed on said second lateral edge of said first half pipe, said plurality of first tubes being evenly spaced apart from each other, each of said plurality of first tubes being spaced from a respective one of said first end and said second end of said first half pipe, each of said plurality of first tubes being oriented to extend longitudinally along said second lateral edge of said first half pipe, said second half pipe having a plurality of second tubes each being disposed on said first lateral edge of said second half pipe, said plurality of second tubes being evenly spaced apart from each other, each of said plurality of second tubes being spaced from a respective one of said first end and said second end of said second half pipe, each of said plurality of second tubes being oriented to extend longitudinally along said first lateral edge of said second half pipe, said plurality of first tubes being interlaced with said plurality of second tubes;

a pin extending through each of said plurality of first tubes and each of said plurality of second tubes for hingedly retaining said first half pipe on said second half pipe, said pin having a pair of heads each being disposed on opposing ends of said pin to inhibit said pin from being removed from said plurality of first tubes and said plurality of second tubes;

a pair of pads, each of said pads being bonded to a respective one of said pair of half pipes, each of said pads being comprised of a resiliently compressible material thereby facilitating each of pair of pads to compressed against said pole when said pair pads is positioned in said closed position around said pole thereby inhibiting said pair of pads from sliding on said pole, each of said pads having a bonded surface being bonded to said inwardly facing surface of said respective half pipe, each of said pair of pads extending a substantial distance between said first end and said second end of said respective half pipe, each of said pair of pads extending a substantial distance between said first lateral edge and said second lateral edge of said respective half pipe, each of said pair of pads being centrally located on said inwardly facing surface of said respective half pipe;

a pair of engagements, each of said pair of engagements being coupled to a respective one of said pair of half pipes, each of said pair of engagements being positioned on said outwardly facing surface of said second half pipe, each of said pair of engagements being aligned with said second lateral edge of said second half pipe, each of said engagements having a finger which curls away from said second lateral edge of said second half pipe; and a pair of latches, each of said latches being movably attached to a respective one of said pair of half pipes, each of said latches being urgeable into a locking condition having each of said latches engaging a respective one of said pair of engagements for retaining said pair of half pipes in said closed position, each of said latches being urgeable into an unlocking condition having each of said latches being disengaged from said respective engagement for facilitating said pair of half pipes to be positioned in an open position, each of said latches being positioned on said outwardly facing surface of said first half pipe, each of said latches being aligned with said first lateral edge of said first half pipe, each of said pair of latches being aligned with a respective one of said pair of engagements, each of said latches including a lever pivotally attached to said outwardly facing surface of said first half pipe and a loop movably attached to said lever, said loop extending around said finger associated with said respective engagement and urging said second lateral edge of said second half pipe to compress against said second lateral edge of said first half pipe when said lever is pivoted into a closing position, said loop being displaced from said finger associated with said respective engagement to facilitate said second lateral edge of said second half pipe to be spaced from said first lateral edge of said first half pipe.

* * * * *